US008622037B2

(12) United States Patent
David et al.

(10) Patent No.: US 8,622,037 B2
(45) Date of Patent: Jan. 7, 2014

(54) HARMONIC DRIVE CAMSHAFT PHASER WITH A COMPACT DRIVE SPROCKET

(75) Inventors: Pascal David, Beidweiler (LU); Pierre Kimus, Attert (BE); Michael J. Fox, Stafford, NY (US)

(73) Assignee: Delphi Technologies, Inc., Troy, MI (US)

( * ) Notice: Subject to any disclaimer, the term of this patent is extended or adjusted under 35 U.S.C. 154(b) by 319 days.

(21) Appl. No.: 13/102,138

(22) Filed: May 6, 2011

(65) Prior Publication Data

US 2011/0277713 A1 Nov. 17, 2011

Related U.S. Application Data

(60) Provisional application No. 61/333,775, filed on May 12, 2010.

(51) Int. Cl.
*F01L 1/32* (2006.01)
*F01L 1/02* (2006.01)

(52) U.S. Cl.
USPC ..... 123/90.17; 123/90.31

(58) Field of Classification Search
USPC ..... 123/90.15, 90.17, 90.31
See application file for complete search history.

(56) References Cited

U.S. PATENT DOCUMENTS 5,163,872 A * 11/1992 Niemiec et al. ..... 464/2
5,417,186 A 5/1995 Elrod et al.
6,257,186 B1 7/2001 Heer
6,328,006 B1 12/2001 Heer
7,100,556 B2 * 9/2006 Sugiura ..... 123/90.17
7,278,386 B2 * 10/2007 Hori et al. ..... 123/90.17
7,421,990 B2 * 9/2008 Taye et al. ..... 123/90.17
8,151,751 B2 * 4/2012 Shiino et al. ..... 123/90.17
8,322,318 B2 * 12/2012 David et al. ..... 123/90.17
2005/0022765 A1 * 2/2005 Takenaka et al. ..... 123/90.17
2008/0047511 A1 * 2/2008 Taye et al. ..... 123/90.17
2009/0199797 A1 * 8/2009 Schafer et al. ..... 123/90.17
2009/0293826 A1 * 12/2009 Lancefield et al. ..... 123/90.17
2010/0024754 A1 * 2/2010 Kameda et al. ..... 123/90.17
2010/0064998 A1 * 3/2010 Hale et al. ..... 123/90.17
2011/0030631 A1 2/2011 David et al.
2011/0030632 A1 * 2/2011 David et al. ..... 123/90.17
2011/0277713 A1 * 11/2011 David et al. ..... 123/90.15
2011/0303169 A1 * 12/2011 Nakamura et al. ..... 123/90.15
2012/0024247 A1 * 2/2012 David et al. ..... 123/90.17
2012/0145104 A1 * 6/2012 David et al. ..... 123/90.17
2012/0186548 A1 * 7/2012 David et al. ..... 123/90.17
2012/0255509 A1 * 10/2012 Lichti et al. ..... 123/90.15
2012/0291729 A1 * 11/2012 David et al. ..... 123/90.15
2012/0312258 A1 * 12/2012 Kimus et al. ..... 123/90.15
2012/0318219 A1 * 12/2012 Fischer ..... 123/90.15
2013/0019825 A1 * 1/2013 Fischer ..... 123/90.15
2013/0081587 A1 * 4/2013 David et al. ..... 123/90.17

* cited by examiner

*Primary Examiner* — Thomas Denion
*Assistant Examiner* — Steven D Shipe
(74) *Attorney, Agent, or Firm* — Thomas N. Twomey

(57) ABSTRACT

A camshaft phaser includes a housing with an array of internal splines formed within a bore. A harmonic gear drive unit is disposed within the housing and includes a circular spline and a dynamic spline, a flexspline disposed radially within the circular spline and the dynamic spline, a wave generator disposed radially within the flexspline, and a rotational actuator connectable to the wave generator. One of the circular spline and the dynamic spline is fixed to the housing. A hub is rotatably disposed radially within the housing and attachable to the camshaft and fixed to the other of the circular spline and the dynamic spline. A back plate has an array of external splines engaged in a sliding fit in a sliding fit with the array of internal splines for transmitting torque from the back plate to said housing. The back plate also has an input sprocket for receiving rotational motion, in use.

18 Claims, 3 Drawing Sheets

HARMONIC DRIVE CAMSHAFT PHASER WITH A COMPACT DRIVE SPROCKET

CROSS-REFERENCE TO RELATED APPLICATIONS

This application claims the benefit of U.S. provisional patent application Ser. No. 61/333,775 filed May 12, 2010, the disclosure of which is hereby incorporated by reference in its entirety.

TECHNICAL FIELD OF INVENTION

The present invention relates to an electric variable cam phaser (eVCP) which uses an electric motor and a harmonic drive unit to vary the phase relationship between a crankshaft and a camshaft in an internal combustion engine; more particularly, to an eVCP where a sprocket used to drive the eVCP is smaller in diameter than a housing containing the eVCP; and even more particularly to an eVCP using a sleeve gear type joint to rotationally fix a sprocket used to drive the eVCP to a housing containing the harmonic drive unit.

BACKGROUND OF INVENTION

Camshaft phasers ("cam phasers") for varying the timing of combustion valves in internal combustion engines are well known. A first element, known generally as a sprocket element, is driven by a chain, belt, or gearing from an engine's crankshaft. A second element, known generally as a camshaft plate, is mounted to the end of an engine's camshaft.

U.S. Pat. No. 7,421,990 B2 discloses an eVCP comprising first and second harmonic gear drive units facing each other along a common axis of the camshaft and the phaser and connected by a common flexible spline (flexspline). The first, or input, harmonic drive unit is driven by an engine sprocket, and the second, or output, harmonic drive unit is connected to an engine camshaft.

A first drawback of this arrangement is that the overall phaser package is undesirably bulky in an axial direction and thus consumptive of precious space in an engine's allotted envelope in a vehicle.

A second drawback is that two complete wave generator units are required, resulting in complexity of design and cost of fabrication.

A third drawback is that the phaser has no means to move the driven unit and attached camshaft to a phase position with respect to the crankshaft that would allow the engine to start and/or run in case of drive motor power malfunction. eVCPs have been put into production by two Japanese car manufacturers; interestingly, these devices have been limited to very low phase shift authority despite the trend in hydraulic variable cam phasers (hVCP) to have greater shift authority. Unlike hVCP, the prior art eVCP has no default seeking or locking mechanism. Thus, phase authority in production eVCPs to date has been undesirably limited to a low phase angle to avoid a stall or no-restart condition if the rotational position of the eVCP is far from an engine-operable position when it experiences electric motor or controller malfunction.

U.S. patent application Ser. No. 12/536,575 and US Patent Application Publication No. 2011/0030632-A1 which are commonly owned by Applicant disclose an eVCP camshaft phaser comprising a flat harmonic drive unit having a circular spline and a dynamic spline linked by a common flexspline within the circular and dynamic splines, and a single wave generator disposed within the flexspline. The circular spline is connectable to either of an engine camshaft or an engine crankshaft driven sprocket circumferentially surrounding and rotationally fixed to the outside diameter of a housing, the dynamic spline being connectable to the other thereof. The wave generator is driven selectively by an electric motor to cause the dynamic spline to rotate past the circular spline, thereby changing the phase relationship between the crankshaft and the camshaft. The electric motor may be equipped with an electromagnetic brake. At least one coaxial coil spring is connected to the sprocket and to the phaser hub and is positioned and tensioned to bias the phaser and camshaft to a default position wherein the engine can run or be restarted should control of the electric motor be lost resulting in the electric motor being unintentionally de-energized or held in an unintended energized position.

Engine applications exist that require that the drive sprocket be made smaller in diameter than the housing to which it will be transmitting torque. The logical solution used in hydraulic type phasers is to place the small diameter gear axially behind the phasing mechanism, integral with a plate or rear cover, which is then fixed to the rear of the housing. However, implementing this solution with the eVCP presents two challenges. The first challenge is that offsetting the drive sprocket so far rearward would offset the radial drive load so far from the journal bearing that binding or wear problems could result. Increasing the length of the journal bearing to compensate for the offsetting of the drive sprocket is not practical due to the need for axial compactness. The second challenge is that the spring plate now needs to transmit the drive torque to the housing. The knurled press fit design presently known is not adequate to transmit this drive torque load.

While the eVCP does not rely on engine oil to actuate, it does rely on engine oil to lubricate the harmonic drive unit and bearings. In order to minimize parasitic oil pressure loss, the amount of oil flow used to lubricate the eVCP needs to be held to a minimum. This results in a dead headed oiling system in which there is not enough oil flowing through the eVCP to flush out contaminants. This allows the contaminants to accumulate within the eVCP which may lead to premature wear.

What is needed is an eVCP with a drive sprocket smaller in diameter than the housing which does not result in binding or wearing problems to the journal bearing. What is also needed is an eVCP that has a spring plate which is able to transmit the drive torque to the housing. What is also needed is an eVCP that prevents the accumulation of contaminants that may lead to premature wear of eVCP components.

SUMMARY OF THE INVENTION

Briefly described, a camshaft phaser is provided for controllably varying the phase relationship between a crankshaft and a camshaft in an internal combustion engine. The camshaft phaser includes a housing having a bore with a longitudinal axis and an array of internal splines formed within the bore. A harmonic gear drive unit is disposed within the housing, the harmonic gear drive unit comprising a circular spline and an axially adjacent dynamic spline, a flexspline disposed within the circular spline and the dynamic spline, a wave generator disposed within the flexspline, and a rotational actuator connectable to the wave generator such that rotation of the wave generator causes relative rotation between the circular spline and the dynamic spline. One of the circular spline and the dynamic spline is fixed to the housing in order to prevent relative rotation therebetween. An output hub is rotatably disposed within the housing axially adjacent to the harmonic gear drive unit and attachable to the camshaft and fixed to the other of the circular spline and the dynamic spline in order to prevent relative rotation therebetween. A back plate has an array of external splines engaged in a sliding fit with the array of internal splines for transmitting torque from the back plate to the housing. The back plate also has an input sprocket for receiving rotational motion, in use, from the crankshaft.

BRIEF DESCRIPTION OF DRAWINGS

This invention will be further described with reference to the accompanying drawings in which.

DETAILED DESCRIPTION OF INVENTION

Figure 1:
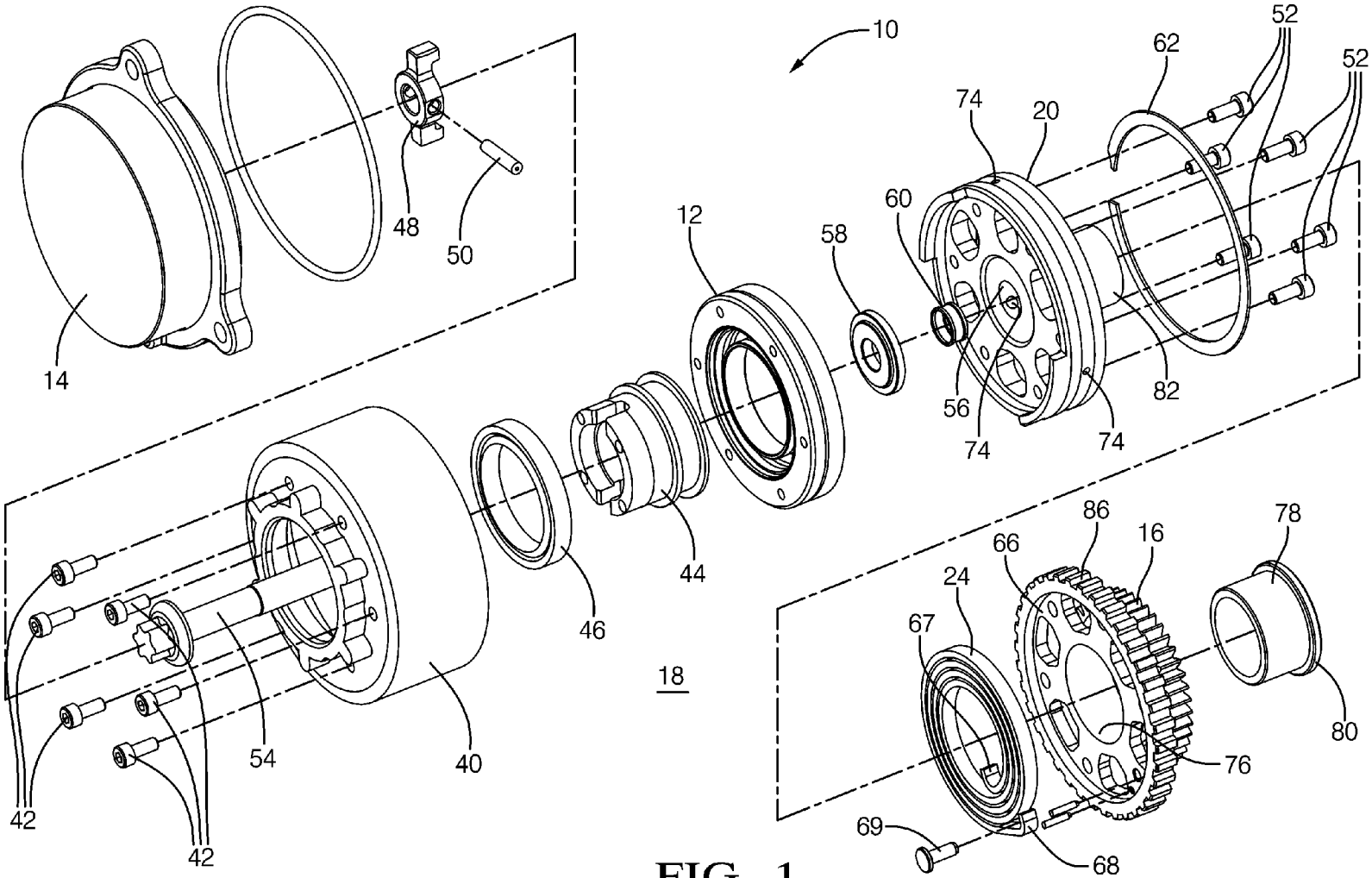
FIG. 1 is an exploded isometric view of an eVCP in accordance with the present invention.
Figure 2:
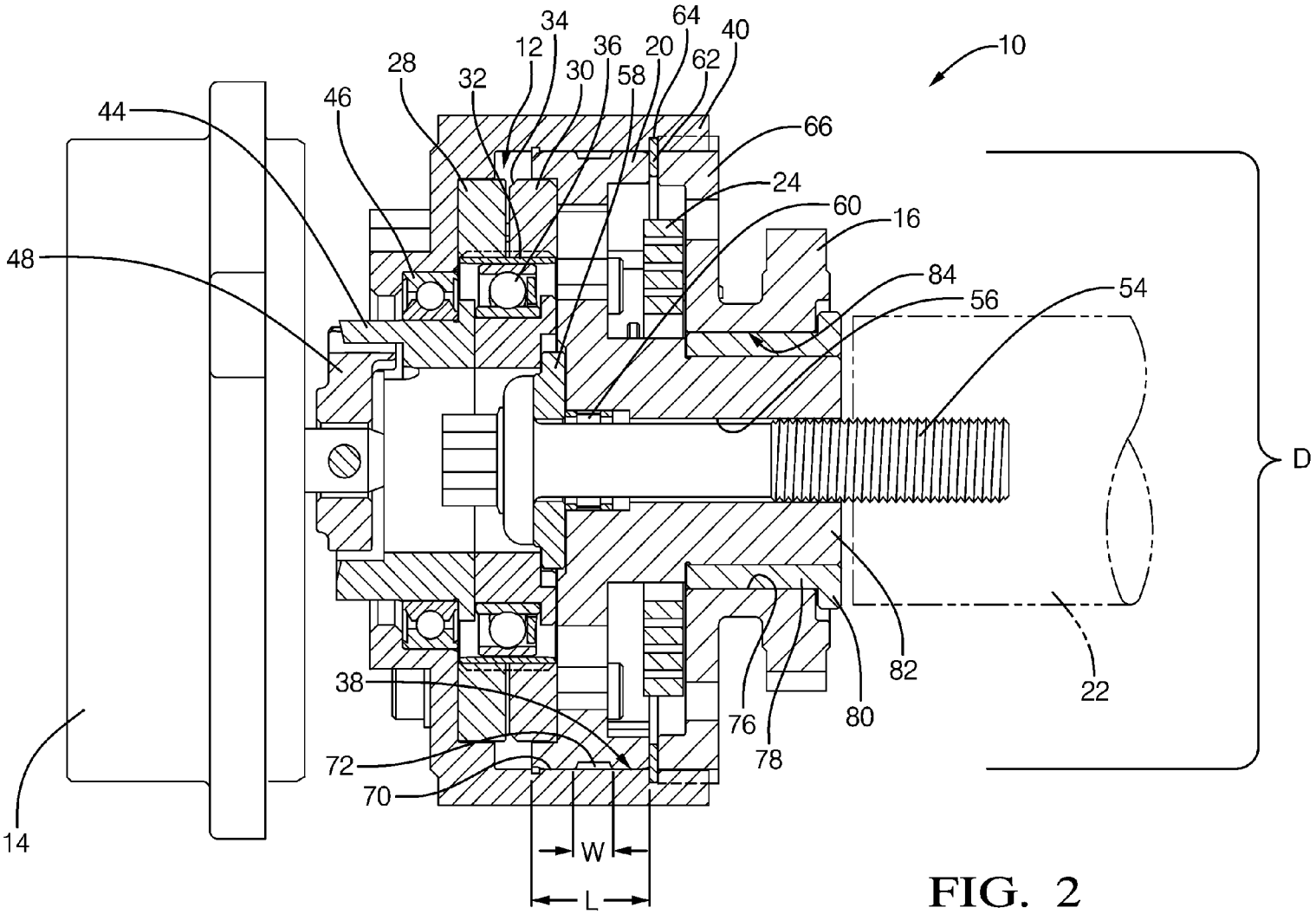
FIG. 2 is an axial cross-section of an eVCP in accordance with the present invention.

Referring to FIGS. 1 and 2, an eVCP 10 in accordance with the present invention includes a flat harmonic gear drive unit 12; a rotational actuator 14 that may be a hydraulic motor but is preferably a DC electric motor, operationally connected to harmonic gear drive unit 12; an input sprocket 16 operationally connected to harmonic gear drive unit 12 and drivable by a crankshaft (not shown) of engine 18; an output hub 20 attached to harmonic gear drive unit 12 and mountable to an end of an engine camshaft 22; and a bias spring 24 operationally disposed between output hub 20 and input sprocket 16. Electric motor 14 may be an axial-flux DC motor.

Harmonic gear drive unit 12 comprises an outer first spline 28 which may be either a circular spline or a dynamic spline as described below; an outer second spline 30 which is the opposite (dynamic or circular) of first spline 28 and is coaxially positioned adjacent first spline 28; a flexspline 32 disposed radially inwards of both first and second splines 28, 30 and having outwardly-extending gear teeth disposed for engaging inwardly-extending gear teeth on both first and second splines 28, 30; and a wave generator 36 disposed radially inwards of and engaging flexspline 32.

Flexspline 32 is a non-rigid ring with external teeth on a slightly smaller pitch diameter than the circular spline. It is fitted over and elastically deflected by wave generator 36.

The circular spline is a rigid ring with internal teeth engaging the teeth of flexspline 32 across the major axis of wave generator 36.

The dynamic spline is a rigid ring having internal teeth of the same number as flexspline 32. It rotates together with flexspline 32 and serves as the output member. Either the dynamic spline or the circular spline may be identified by a chamfered corner 34 at its outside diameter to distinguish one spline from the other.

As is disclosed in the prior art, wave generator 36 is an assembly of an elliptical steel disc supporting an elliptical bearing, the combination defining a wave generator plug. A flexible bearing retainer surrounds the elliptical bearing and engages flexspline 32. Rotation of the wave generator plug causes a rotational wave to be generated in flexspline 32 (actually two waves 180° apart, corresponding to opposite ends of the major ellipse axis of the disc).

During assembly of a harmonic gear drive unit 12, flexspline teeth engage both circular spline teeth and dynamic spline teeth along and near the major elliptical axis of the wave generator. The dynamic spline has the same number of teeth as the flexspline, so rotation of the wave generator causes no net rotation per revolution therebetween. However, the circular spline has slightly fewer gear teeth than does the dynamic spline, and therefore the circular spline rotates past the dynamic spline during rotation of the wave generator plug, defining a gear ratio therebetween (for example, a gear ratio of 50:1 would mean that 1 rotation of the circular spline past the dynamic spline corresponds to 50 rotations of the wave generator). Harmonic gear drive unit 12 is thus a high-ratio gear transmission; that is, the angular phase relationship between first spline 28 and second spline 30 changes by 2% for every revolution of wave generator 36.

Of course, as will be obvious to those skilled in the art, the circular spline rather may have slightly more teeth than the dynamic spline has, in which case the rotational relationships described below are reversed.

Still referring to FIGS. 1 and 2, input sprocket 16 is rotationally fixed to a generally cup-shaped sprocket housing 40 that is fastened by bolts 42 to first spline 28. Coupling adaptor 44 is mounted to wave generator 36 and extends through sprocket housing 40, being supported by bearing 46 mounted in sprocket housing 40. Coupling 48 mounted to the motor shaft of electric motor 14 and pinned thereto by pin 50 engages coupling adaptor 44, permitting wave generator 36 to be rotationally driven by electric motor 14, as may be desired to alter the phase relationship between first spline 28 and second spline 30.

Output hub 20 is fastened to second spline 30 by bolts 52 and may be secured to engine camshaft 22 by central through-bolt 54 extending through output hub axial bore 56 in output hub 20, and capturing stepped thrust washer 58 and filter 60 recessed in output hub 20. In an eVCP, it is necessary to limit radial run-out between the input hub and output hub. In the prior art, this has been done by providing multiple roller bearings to maintain concentricity between the input and output hubs. Referring to FIG. 2, radial run-out is limited by a single journal bearing interface 38 between sprocket housing 40 (input hub) and output hub 20, thereby reducing the overall axial length of eVCP 10 and its cost to manufacture. Output hub 20 is retained within sprocket housing 40 by snap ring 62 disposed in an annular groove 64 formed in sprocket housing 40.

Back plate 66, which is integrally formed with input sprocket 16, captures bias spring 24 against output hub 20. Inner spring tang 67 is engaged by output hub 20, and outer spring tang 68 is attached to back plate 66 by pin 69. In the event of an electric motor malfunction, bias spring 24 is biased to back-drive harmonic gear drive unit 12 without help from electric motor 14 to a rotational position of second spline 30 wherein engine 18 will start or run, which position may be at one of the extreme ends of the range of authority or intermediate of the phaser's extreme ends of its rotational range of authority. For example, the rotational range of travel in which bias spring 24 biases harmonic gear drive unit 12 may be limited to something short of the end stop position of the phaser's range of authority. Such an arrangement would be useful for engines requiring an intermediate park position for idle or restart.

The nominal diameter of output hub 20 is D; the nominal axial length of first journal bearing 70 is L; and the nominal axial length of the oil groove 72 formed in either output hub 20 (shown) and/or in sprocket housing 40 (not shown) for supplying oil to first journal bearing 70 is W. In addition to journal bearing clearance, the length L of the journal bearing in relation to output hub diameter D controls how much output hub 20 can tip within sprocket housing 40. The width of oil groove 72 in relation to journal bearing length L controls how much bearing contact area is available to carry the radial load. Experimentation has shown that a currently preferred range of the ratio L/D may be between about 0.25 and about 0.40, and that a currently preferred range of the ratio W/L may be between about 0.15 and about 0.70.

Oil provided by engine 18 is supplied to oil groove 72 by one or more oil passages 74 that extend radially from output hub axial bore 56 of output hub 20 to oil groove 72. Filter 60 filters contaminants from the incoming oil before entering oil passages 74. Filter 60 also filters contaminants from the incoming oil before being supplied to harmonic gear drive unit 12 and bearing 46. Filter 60 is a band-type filter that may be a screen or mesh and may be made from any number of different materials that are known in the art of oil filtering.

Extension portion 82 of output hub 20 receives bushing 78 in a press fit manner. In this way, output hub 20 is fixed to bushing 78. Input sprocket axial bore 76 interfaces in a sliding fit manner with bushing 78 to form second journal bearing 84. This provides support for the radial drive load placed on input sprocket 16 and prevents the radial drive load from tipping output hub 20/first journal bearing 70 which could cause binding and wear issues for first journal bearing 70. Bushing 78 includes radial flange 80 which serves to axially retain back plate 66/input sprocket 16. Alternatively, but not shown, bushing 78 may be eliminated and input sprocket axial bore 76 could interface in a sliding fit manner with extension portion 82 of output hub 20 to form second journal bearing 84 and thereby provide the support for the radial drive load placed on input sprocket 16. In this alternative, back plate 66/input sprocket 16 may be axially retained by a snap ring (not shown) received in a groove (not shown) of extension portion 82.

Figure 3:
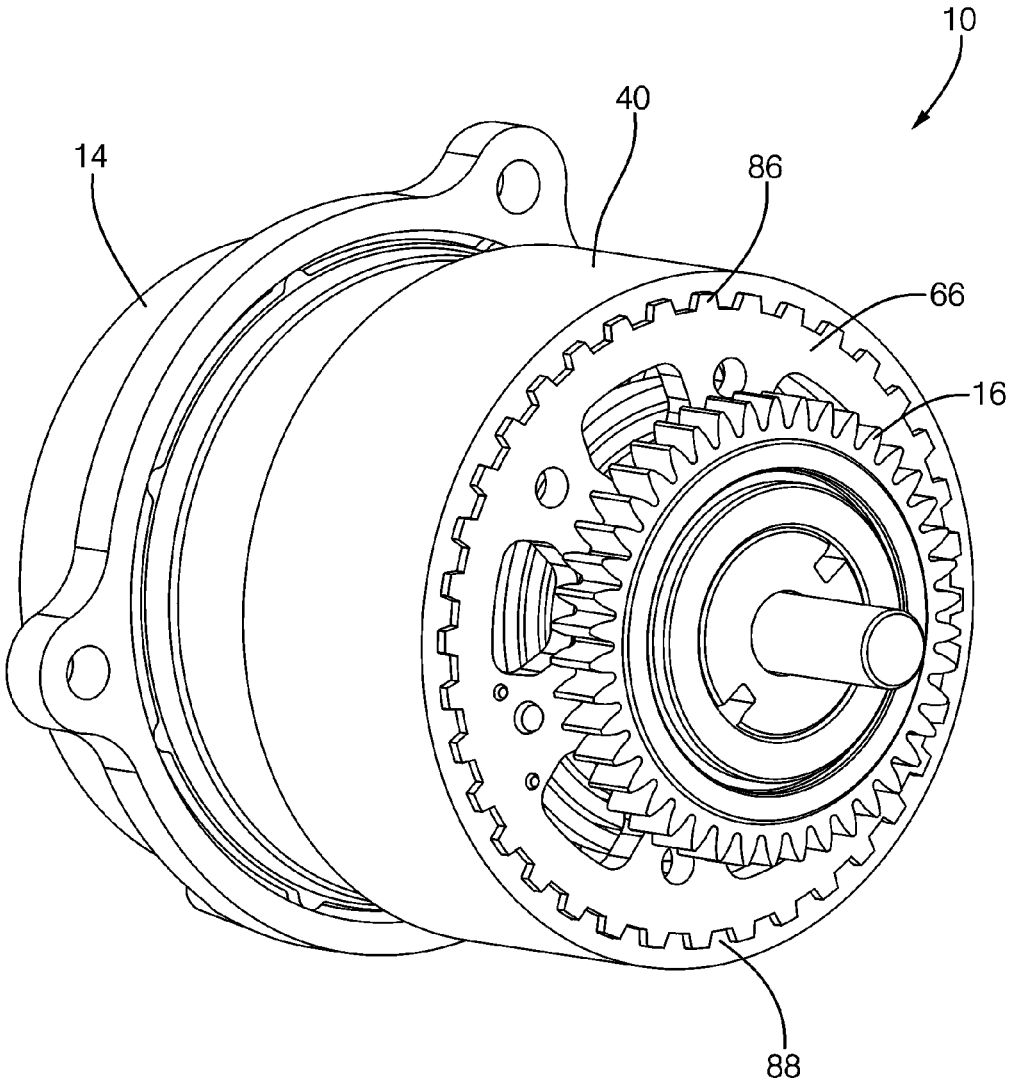
FIG. 3 is an isometric view of an eVCP in accordance with the present invention.

In order to transmit torque from input sprocket 16/back plate 66 to sprocket housing 40 and referring to FIGS. 1-3, a sleeve gear type joint is used in which back plate 66 includes an array of external splines 86 which slidingly fit with an array of internal splines 88 included within sprocket housing 40. The sliding fit nature of the splines 86, 88 eliminates or significantly reduces the radial tolerance stack issue between first journal bearing 70 and second journal bearing 84 because the two journal bearings 70, 84 operate independently and do not transfer load from one to the other, thereby preventing binding between output hub 20 and sprocket housing 40. If this tolerance stack issue were not resolved, manufacture of the two journal bearings would be prohibitive in mass production because of component size and concentricity tolerances that would need to be maintained. The sleeve gear arrangement also eliminates then need for a bolted flange arrangement to rotationally fix back plate 66 to sprocket housing 40 which minimizes size and mass. Additionally, splines 86, 88 lend themselves to fabrication methods where they can be net formed onto back plate 66 and into sprocket housing 40 respectively. Splines 86, 88 may be made, for example, by powder metal process or by standard gear cutting methods.

While extension portion 82 has been described and shown as being integrally formed with output hub 20, it should now be understood that other arrangements could also be used while obtaining the same effect. One alternative that may be employed is to use an extended length camshaft which extends through input sprocket 16 in a sliding fit manner to form a journal bearing therewith. After central through-bolt 54 has been tightened, this alternative arrangement would effectively be equivalent to providing the output hub with an extension portion.

While eVCP is driven by a crankshaft through input sprocket 16, it should now be understood that other known drive arrangements, for example a pulley or a gear, may also be used and fall within the scope of the term "sprocket."

While the invention has been described by reference to various specific embodiments, it should be understood that numerous changes may be made within the spirit and scope of the inventive concepts described. Accordingly, it is intended that the invention not be limited to the described embodiments, but rather only to the extent set forth in the claims that follow.

We claim:

1. A camshaft phaser for controllably varying the phase relationship between a crankshaft and a camshaft in an internal combustion engine, said camshaft phaser comprising:

a housing having a bore with a longitudinal axis and an array of internal splines formed within said bore;

a harmonic gear drive unit disposed within said housing, said harmonic gear drive unit comprising a circular spline and an axially adjacent dynamic spline, a flexspline disposed within said circular spline and said dynamic spline, a wave generator disposed within said flexspline, and a rotational actuator connectable to said wave generator such that rotation of said wave generator causes relative rotation between said circular spline and said dynamic spline, wherein one of said circular spline and said dynamic spline is fixed to said housing in order to prevent relative rotation therebetween;

an output hub rotatably disposed within said housing axially adjacent to said harmonic gear drive unit and attachable to said camshaft and fixed to the other of said circular spline and said dynamic spline in order to prevent relative rotation therebetween;

a back plate having an array of external splines engaged in a sliding fit with said array of internal splines for transmitting torque from said back plate to said housing, said external splines and said internal splines preventing binding between said output hub and said housing, said back plate also having an input sprocket for receiving rotational motion, in use, from said crankshaft.

2. A camshaft phaser as in claim 1 wherein an extension portion of said output hub extends axially through an axial bore of said back plate and said input sprocket in a sliding fit manner to provide support for a radial drive load placed on said input sprocket in use.

3. A camshaft phaser as in claim 2 wherein a bushing is disposed between said extension portion and said axial bore, and wherein said bushing is press fit onto said extension portion.

4. A camshaft phaser as in claim 2 wherein a bearing surface interface is formed between said housing and said output hub and wherein said sliding fit manner of said extension portion and said axial bore substantially prevents transmission of said radial drive load to said bearing surface interface by preventing tipping of said output hub.

5. A camshaft phaser as in claim 1 wherein said input sprocket is smaller in diameter than said housing.

6. A camshaft phaser as in claim 1 wherein said output hub is retained within said housing by a snap ring disposed in an annular groove formed within said housing.

7. A camshaft phaser for controllably varying the phase relationship between a crankshaft and a camshaft in an internal combustion engine, said camshaft phaser comprising:

a housing having a bore with a longitudinal axis and an array of internal splines formed within said bore;

a harmonic gear drive unit disposed within said housing, said harmonic gear drive unit comprising a circular spline and an axially adjacent dynamic spline, a flexspline disposed within said circular spline and said dynamic spline, a wave generator disposed within said flexspline, and a rotational actuator connectable to said wave generator such that rotation of said wave generator causes relative rotation between said circular spline and said dynamic spline, wherein one of said circular spline and said dynamic spline is fixed to said housing in order to prevent relative rotation therebetween;

an output hub rotatably disposed within said housing axially adjacent to said harmonic gear drive unit and attachable to said camshaft and fixed to the other of said circular spline and said dynamic spline in order to prevent relative rotation therebetween;

a back plate having an input sprocket for receiving rotational motion, in use, from said crankshaft, said back plate also having an array of external splines engaged in a sliding fit with said array of internal splines for transmitting torque from said back plate to said housing such that said housing is driven by said crankshaft through said back plate, said external splines and said internal splines preventing binding between said output hub and said housing.

8. A camshaft phaser as in claim 7 wherein an extension portion of said output hub extends axially through an axial bore of said back plate and said input sprocket in a sliding fit manner to provide support for a radial drive load placed on said input sprocket in use.

9. A camshaft phaser as in claim 8 wherein a bushing is disposed between said extension portion and said axial bore, and wherein said bushing is press fit onto said extension portion.

10. A camshaft phaser as in claim 8 wherein a bearing surface interface is formed between said housing and said output hub and wherein said sliding fit manner of said extension portion and said axial bore substantially prevents transmission of said radial drive load to said bearing surface interface by preventing tipping of said output hub.

11. A camshaft phaser as in claim 7 wherein said input sprocket is smaller in diameter than said housing.

12. A camshaft phaser as in claim 7 wherein said output hub is retained within said housing by a snap ring disposed in an annular groove formed within said housing.

13. A camshaft phaser for controllably varying the phase relationship between a crankshaft and a camshaft in an internal combustion engine, said camshaft phaser comprising:

a housing having a first array of splines and a bore with a longitudinal axis;

a harmonic gear drive unit disposed within said housing, said harmonic gear drive unit comprising a circular spline and an axially adjacent dynamic spline, a flexspline disposed within said circular spline and said dynamic spline, a wave generator disposed within said flexspline, and a rotational actuator connectable to said wave generator such that rotation of said wave generator causes relative rotation between said circular spline and said dynamic spline, wherein one of said circular spline and said dynamic spline is fixed to said housing in order to prevent relative rotation therebetween;

an output hub rotatably disposed within said housing axially adjacent to said harmonic gear drive unit and attachable to said camshaft and fixed to the other of said circular spline and said dynamic spline in order to prevent relative rotation therebetween;

a back plate having an input sprocket for receiving rotational motion, in use, from said crankshaft, said back plate also having a second array of splines engaged in a sliding fit with said first array of splines for transmitting torque from said back plate to said housing such that said housing is driven by said crankshaft through said back plate, said first array of splines and said second array of splines preventing binding between said output hub and said housing.

14. A camshaft phaser as in claim 13 wherein an extension portion of said output hub extends axially through an axial bore of said back plate and said input sprocket in a sliding fit manner to provide support for a radial drive load placed on said input sprocket in use.

15. A camshaft phaser as in claim 14 wherein a bushing is disposed between said extension portion and said axial bore, and wherein said bushing is press fit onto said extension portion.

16. A camshaft phaser as in claim 14 wherein a bearing surface interface is formed between said housing and said output hub and wherein said sliding fit manner of said extension portion and said axial bore substantially prevents transmission of said radial drive load to said bearing surface interface by preventing tipping of said output hub.

17. A camshaft phaser as in claim 13 wherein said input sprocket is smaller in diameter than said housing.

18. A camshaft phaser as in claim 13 wherein said output hub is retained within said housing by a snap ring disposed in an annular groove formed within said housing.

* * * * *